US006405790B1

(12) United States Patent
van Haag

(10) Patent No.: US 6,405,790 B1
(45) Date of Patent: Jun. 18, 2002

(54) ROLL

(75) Inventor: Rolf van Haag, Kerken (DE)

(73) Assignee: Voith Sulzer Finishing GmbH, Krefeld (DE)

( * ) Notice: Subject to any disclaimer, the term of this patent is extended or adjusted under 35 U.S.C. 154(b) by 0 days.

(21) Appl. No.: 08/879,140

(22) Filed: Jun. 19, 1997

(30) Foreign Application Priority Data

Jun. 21, 1996 (DE) ..... 196 24 737

(51) Int. Cl.[7] ..... F28F 5/02

(52) U.S. Cl. ..... 165/90; 165/89; 492/46; 34/124

(58) Field of Search ..... 165/272, 90, 89, 165/104.22, 104.21; 492/46; 34/124

(56) References Cited

U.S. PATENT DOCUMENTS

| | | | | |
|---|---|---|---|---|
| 2,547,086 A | * | 4/1951 | McDermott | 165/91 |
| 3,771,591 A | * | 11/1973 | Larsen | 165/1 |
| 4,183,298 A | * | 1/1980 | Cappel et al. | 101/348 |
| 4,235,002 A | * | 11/1980 | Pav et al. | 29/110 |
| 4,631,016 A | * | 12/1986 | Hay | 425/224 |
| 4,805,690 A | | 2/1989 | Minami et al. | |
| 5,676,754 A | * | 10/1997 | Helms | 118/101 |

FOREIGN PATENT DOCUMENTS

| | | |
|---|---|---|
| DE | 2324611 | 11/1974 |
| DE | 2400615 | 7/1975 |
| DE | 225767 | 8/1985 |
| DE | 4111911 | 10/1992 |
| EP | 0292123 | 11/1988 |
| EP | 0567875 | 11/1993 |
| JP | 58-61318 | 4/1983 |
| JP | 56128317 | 8/1983 |
| JP | 60-38717 | 11/1985 |
| JP | 8-145045 | 6/1996 |

OTHER PUBLICATIONS

Copy of a Japanese Office Action dated Jun. 16, 1998 performed in connection with Japanese Patent Application No. HEI 9–154656.

* cited by examiner

*Primary Examiner*—Henry Bennett
*Assistant Examiner*—Terrel McKinnon
(74) *Attorney, Agent, or Firm*—Greenblum & Bernstein, P.L.C.

(57) ABSTRACT

Soft roll that may include a roll tube having an outside surface and a sealed interior space, and an elastic coating provided on the outside surface. The sealed interior space may include a vaporizable liquid and a heat exchanger for cooling heat generated in the roll during use. The sealed interior space may be gas-tight and the temperature of the heat exchanger may be set to condense vaporized liquid.

32 Claims, 1 Drawing Sheet

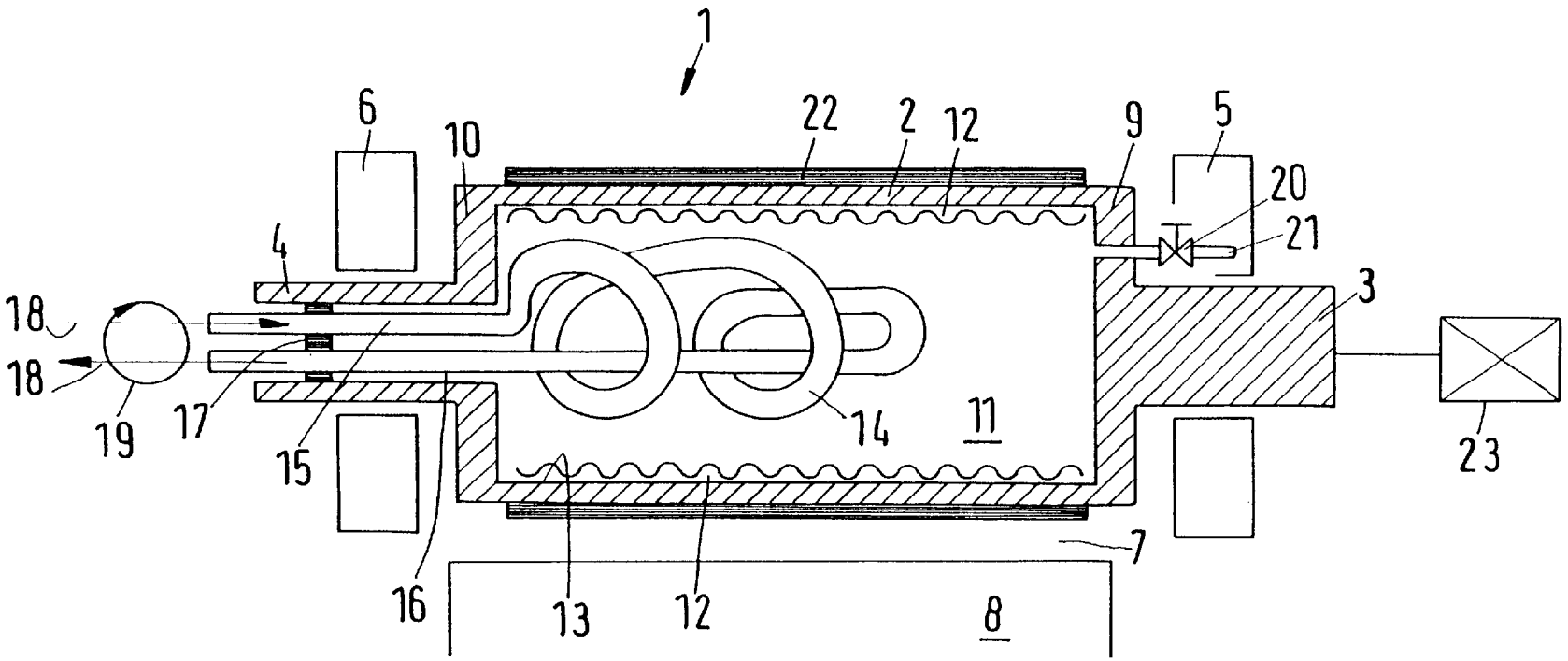
1
2
3
4
5
6
7
8
9
10
11
12
12
13
14
15
16
17
18
18
19
20
21
22
23

ROLL

CROSS-REFERENCE TO RELATED APPLICATION

The present application claims the priority under 35 U.S.C. §119 of German Patent Application No. 196 24 737.3, filed on Jun. 21, 1996, the disclosure of which is incorporated by reference herein in its entirety.

BACKGROUND OF THE INVENTION

1. Field of Invention

The present invention relates to a roll that includes a roll tube provided with an outer elastic coating. The sealed interior space may include a vaporizable liquid and a heat exchanger for cooling heat generated in the roll during use. The sealed interior space may form a closed system in which the heat in the roll tube may vaporize the vaporizable liquid and the heat exchanger may be set to condense the vaporized liquid.

2. Discussion of Background Information

Rolls of the type generally described above may be utilized, e.g., in supercalenders or soft calenders. Due to the elasticity of their surfaces, these rolls are often also referred to in the art as "soft" rolls. In use, the soft rolls and so-called hard rolls are positioned together form a nip though which, e.g., a material web is conducted to smooth the surface of the web by applying pressure and, if necessary, at an elevated temperature.

During operation, the surface of the soft roll heats up due to, e.g., the flexing work performed by the elastic coating. The resulting high temperature endangers the elastic coating which drastically reduces the roll's protection against destruction.

When a roll tube is utilized as a roll jacket, e.g., in a deflection adjustment roll or deflection compensating roll, the roll jacket is supported by a hydrostatic or hydrodynamic supporting elements. In this manner, heat can be dissipated by providing hydraulic oil in an interior space of the roll. This method for stabilizing the roll temperature, which occurs like a secondary phenomenon with deflection adjustment rolls, however, is relatively costly.

Further, it is known to provide peripheral bores in the roll jacket of "hard" rolls so as to enable a through flow of a heat carrier or coolant, e.g., through peripheral channels extending through the peripheral bores. The heat absorption or emission of this medium, however, must be maintained within relatively close limits so as to prevent an irregular temperature distribution across the width of the roll. In a cooling process, as coolant flows through the peripheral channels, the temperature of the coolant may generally only be allowed a maximum rise of 1° C., and never more than 2° C. Thus, this cooling process requires an adequate volume of coolant.

There is also a possibility of cooling the rolls from the outside, e.g., by blowing with cool air or spraying with cooling liquid. However, these possibilities for cooling the rolls are somewhat limited. In particular, when spraying with a cooling liquid, there is a risk that the cooling liquid may also contact the web being processed, which may adversely affect the intended finishing of the web.

SUMMARY OF THE INVENTION

Accordingly, a particular feature of the present invention may be directed to cooling a soft roll in a simpler manner than that disclosed in the prior art.

To achieve this above-noted feature, a roll may include a roll tube that has an elastic coating provided on an outside of the roll tube. The roll tube may include a sealed interior space within which a vaporizable liquid and a heat exchanger may be positioned.

In operation, the roll and roll tube may rotate. As a result of centrifugal force generated by the rotation of the roll, the liquid provided within the interior space may be pressed against an inside wall of the roll tube to form a liquid film. For practical purposes, an adequate volume of liquid should be provided in the interior space so that a closed film may form that has a thickness of, e.g., several millimeters. Further, heat may be transmitted to the liquid, e.g., from the outside of the roll, i.e., through the roll tube. The transmitted heat may vaporize the liquid to produce steam. The vaporized liquid or steam may contact a heat exchanger so as to withdraw or emit the heat from within the interior space. The steam may then condense or precipitate on the heat exchanger. The condensation, through the centrifugal force, may be forced toward the wall of the interior space, i.e., the inside surface of the roll tube. Thus, the cooling cycle may start over again.

The present invention produces an intensive cooling of the roll tube through relatively simple measures. For example, as the liquid film located on the inside of the roll tube develops evenly, i.e., as a result of the centrifugal force, a similar even heat dissipation may also be produced. Thus, an even temperature can be maintained with good feed across the axial length and circumference of the roll tube.

In a preferred embodiment, the temperature of the heat exchanger may be reduced to a temperature below the condensation temperature of the liquid. As a result, the steam may not only be condensed or precipitated on the heat exchanger, but the condensation may also be additionally cooled. Thus, this embodiment may produce an even greater temperature difference between the roll tube and the heat exchanger. Thus, because the heat exchanger may dissipate a large volume of heat, improved heat dissipation may be achieved through the present invention.

In another preferred embodiment, the interior space may be gas-tight so that no coolant may be lost. Further, the present invention may utilize water as the coolant. Alternatively, other liquids, e.g., those exhibiting a low boiling point, may be utilized as the coolant for the present invention. Accordingly, the ordinarily skilled artisan may set certain temperature limits within which the roll tube may be heated by selecting an appropriate coolant liquid, i.e., according to its boiling point.

In another embodiment of the present invention, the roll may be provided with journal bearings. Further, the interior space of the roll tube may be closed off or defined at the axial extremes of the roll tube by respective journals and associated components or walls. This arrangement may produce a gas-tight interior space. While typical journal bearing rolls of the prior art are generally characterized by a very low dead weight that results in a desired steep characteristic curve in the calender, by utilizing an additional heat exchanger in accordance with the present invention, the roll may be cooled by simple coolants. Thus, flexing work performed in the elastic coating may have no negative effects with respect to the roll temperature and, therefore, reduce the danger of damaging the coating.

In accordance with the present invention, the heat exchanger may jointly rotate with the roll tube. This embodiment may facilitate the sealing of the heat exchanger against the roll tube. That is, if the heat exchanger is jointly mounted with the roll tube, the interior space may be maintained stationary so that none of the gaps between the components have to be sealed. Further, the rotating heat exchanger may produce a better distribution of the liquid that is precipitated on the heat exchanger. Drops of liquid formed from the steam, i.e., which have precipitated at the heat exchanger, may be centrifuged against the wall of the roll tube where they can be revaporized. Thus, this feature of the present invention may act as a kind of pump within the coolant cycle.

In another preferred embodiment of the present invention, a flow of coolant may be fed to the heat exchanger. The application of coolant may be a relatively simple method for dissipating heat from the interior space of the roll tube. It may also be possible to use electrical components having negative temperature coefficients. However, the expenditure for dissipating volumes of heat may be relatively high. The coolant may be heated relatively fast in the heat exchanger. However, in contrast to the prior art, the present invention is not limited to allowing heating by only 1° C. or 2° C. Further, the cooling liquid may increase by 10° C., 20° C. or to an even higher temperature. As the temperature of the cooling liquid increases, a correspondingly lower flow volume of cooling liquid through the heat exchanger may be required for dissipating the same volume of heat. Thus, in accordance with this particular embodiment of the present invention, there may be substantially no risk of an uneven temperature distribution developing in the roll tube.

At least one of the journals of the roll tube may be provided with a rotary feeding device, which may be any conventional type rotary feeding device. As this arrangement requires conveyance or flow of liquids, the difficulty associated with sealing this arrangement may be less complicated than when a conveyance of gas is utilized. The rotary feeding device may be arranged at a side or an end of the heat exchanger which is not connected to nor within the interior space. In this manner, the present invention does not risk allowing gas or steam to escape from the interior space through the rotary feeding device.

The heat exchanger may be formed, e.g., as a helical tube which may enable the heat exchanger to extend over a certain area along the axis of the roll tube. The surface available for the heat exchange, i.e., between the coolant fed through the heat exchange tube and the steam contained within the interior space may be enlarged by a simple method.

Further, an evacuating device may be provided in the interior space to reduce the pressure within the interior space. Consequently, the release of pressure correspondingly reduces the boiling temperature of the liquid contained in the interior space. Thus, the pressure may be adjusted to influence the temperature of the roll tube. For example, as the boiling temperature of the liquid is lowered, the faster the liquid evaporates. Since the largest volume of heat may be "consumed" during evaporation, the temperature of the roll tube may be located with good feed in the vicinity of the liquid boiling point in the interior space.

The elastic coating may be made of, e.g., plastic. Further, epoxy resins may also be considered as appropriate synthetic materials, and plastic coatings have been developed that exhibit a high degree of elasticity.

Preferably, a roll rotary drive may be provided for driving the roll tube. The roll rotary drive may enable rotation of the roll, even when no web is being guided through the nip, or when the nip is not yet closed. In this manner, the liquid film may form at the inside of the roll tube prior to initiating the actual calendering operation, so that the cooling may start immediately.

The present invention may be directed to a roll that may include a roll tube having an outside surface and a sealed interior space, and an elastic coating provided on the outside surface. The roll may also include a vaporizable liquid and a heat exchanger that may be positioned within the sealed interior space.

According to another feature of the present invention, a temperature of the heat exchanger may be set to a temperature below a condensation temperature of a vaporized portion of the vaporizable liquid.

According to another feature of the present invention, the sealed interior space may be gas-tight.

According to still another feature of the present invention, the roll may also include journal bearings, journals, and walls. At least one of the journals and the walls may close axial extremities of the interior space.

According to a further feature of the present invention, the heat exchanger may jointly rotate with the roll tube.

According to another feature of the present invention, the heat exchanger may include a coolant supplied from outside of the roll tube. Further, a rotary feeding device may be associated with at least one journal to supply the coolant.

According to a still further feature of the present invention, the heat exchanger may include a helical tube.

According to yet another feature of the present invention, the roll may also include an evacuating device coupled to the interior space.

According to another feature of the present invention, the elastic coating may include plastic.

According to still another feature of the present invention, the roll may also include a roll rotary drive.

The present invention may also be directed to a calender roll that may include a roll tube including a gas-tight section and the gas-tight section including a vaporizable liquid and a heat exchanger.

According to another feature of the present invention, the vaporizable liquid may be adapted to form a film over an interior wall of the gas-tight section.

According to another feature of the present invention, the heat exchanger may be adapted to receive condensed vaporized liquid.

According to a further feature of the present invention, the roll may include a journal and the heat exchanger may extend through the journal. Further, the journal may include a static seal and the heat exchanger may extend through the static seal.

According to still another feature of the present invention, the gas-tight section may form a closed system in which vaporizing the vaporizable liquid cools the roll tube and the heat exchanger cools the vaporized liquid.

According to another feature of the present invention, the roll may include a drive motor for rotating the roll tube and the heat exchanger may be coupled to rotate with the roll tube.

According to a still further feature of the present invention, the roll may include a pressure valve to adjustably vary the pressure within the gas-tight section.

According to another feature of the present invention, the heat exchanger may include a circulating coolant. Further, the coolant may include one of water, alcohols and hydrocarbons.

The present invention may be directed to a method for cooling a roll having an elastic coating in use in a calender. The method may include forming a vaporizable liquid film on an interior surface of the roll, vaporizing the vaporizable liquid film to produce vaporized liquid, condensing the vaporized liquid to produce a condensed liquid, and forcing the condensed liquid onto the interior surface of the roll.

According to another feature of the present invention, the forming of the vaporizable liquid film may include rotating the roll.

According to still another feature of the present invention, the vaporizing of the vaporizable liquid film may include frictionally heating the interior surface to a temperature at least equal to a boiling point temperature of the vaporizable liquid. Further, the frictional heating of the interior surface may include forming a nip between the roll and an opposing roll and rotating the roll and the opposing roll. Alternatively, the frictional heating of the interior surface may include milling the elastic coating.

According to a still further feature of the present invention, the condensing of the vaporized liquid may include positioning a heat exchanger within the roll and circulating a coolant having a temperature less than or equal to the condensation point of the vaporized liquid through the heat exchanger.

According to another feature of the present invention, the method may also include providing a gas-tight seal to enclose the vaporizable liquid within the roll, positioning a heat exchanger within the roll, and circulating a coolant through a heat exchanger to condense the vaporized liquid. Further, the method may include rotating the heat exchanger to remove the condensed vaporized liquid.

According to still another feature of the present invention, the method may also include supplying the coolant from outside of the roll.

According to yet another feature of the present invention, the forcing of the condensed liquid may include positioning a heat exchanger within the roll and rotating the heat exchanger.

Other exemplary embodiments and advantages of the present invention may be ascertained by reviewing the present disclosure and the accompanying drawing FIGURE.

BRIEF DESCRIPTION OF DRAWING

The present invention may be further described in the detailed description which follows, with reference to the noted drawing by way of a non-limiting example of a preferred embodiment of the present invention and wherein:

The FIGURE illustrates a schematic cross-section of the calender roll in accordance with the present invention.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing FIGURE making apparent to those skilled in the art how the invention may be embodied in practice.

A roll 1 may be provided with a roll tube 2 which may be arranged via journals 3 and 4 within bearings 5 and 6 in a calender (not shown in detail). If necessary, bearings 5 and 6 may be raised or lowered in the vertical direction and/or adjusted horizontally so as to selectively open or close a nip 7 with respect to an opposing roll 8.

Journals 3 and 4 may extend from a roll-end extremity, i.e., components or walls 9 and 10, along a central axis of roll tube 2. Roll tube 2, journals 3 and 4, and walls 9 and 10 may enclose and surround an interior space 11 to provide a sealed space.

Sealed interior space 11 may be provided with or contain a predetermined volume of vaporizable liquid 12, e.g., water. The volume of liquid provided should be sufficient, so that during operation, i.e., when the roll is rotating, a liquid film thickness of, e.g., several millimeters may be formed at or along an inside wall 13 of roll tube 2, e.g., by centrifugal force. In the FIGURE, a vaporizable liquid film of vaporizable liquid 12 is schematically illustrated at an upper inside wall and at a lower inside wall of roll tube 2. Clearly, the illustrated wave shaped surface is for the purposes of illustration and explanation of the liquid film layer, and the application should not be construed as limited to an undulating or sinuous film surface along inside wall 13.

A heat exchanger 14 may extend into interior space 11, and may be formed, e.g., as a helical tube, as shown in the exemplary drawing. Heat exchanger 14 may axially extend into interior space 11 via a certain path.

Heat exchanger 14 may be provided with connections 15 and 16 which may be conducted through journal 4. At journal 4, a static seal 17 may be positioned to ensure a gas-tight seal of interior space 11, through which connections 15 and 16 may extend without compromising the sealed nature of interior space 11. Additionally, journal 4 may be positioned, e.g., at the non-drive side or operator side, of roll 1.

Connections 15 and 16 may be utilized to supply and evacuate coolant, e.g., as indicated by arrows 18, through a known rotary feeding device 19. In general, a rotary feeding device requires that components movable in opposition must be sealed, however, in accordance with the present invention, this requirement is not critical. That is, because there is no physical connection between rotary feeding device 19 and interior space 11, there is no danger that the gas-tight seal of the interior space 11 will be compromised by the use of rotary feeding device 19. Accordingly, rotary feeding device 19 allows the admission of coolant liquids or gases only to the interior of heat exchanger 14 through connections 15 and 16, not to interior space 11. The coolant flowing through heat exchanger 14 may be, e.g., water.

Further, interior space 11 may be coupled via an evacuating valve 20 with an evacuating connection 21. Evacuating connection 21 may, e.g., be coupled to a vacuum pump and, if necessary, to a manually operated vacuum pump. Accordingly, when evacuating valve 20 is opened, the pressure within interior space 11 may be reduced. This reduction in internal pressure, therefore, correspondingly reduces the boiling point temperature of liquid 12 contained within interior space. In this manner, the boiling point temperature of the liquid utilized within interior space 11 may be varied in accordance with desired operating parameters.

An elastic coating 22, formed of a synthetic material, e.g., epoxy resin, may be provided around an outside of roll tube 2. During operation of roll 1, i.e., when rolls 1 and 8 interact to treat the web guided through the formed nip, coating 22 may be milled. The milling of coating 22 may produce heat that may increase both the temperature of coating 22 and the temperature of roll tube 2.

Further, as roll 1 rotates, a centrifugal force is created or results within roll 1 to form a closed liquid film along inside wall 13 of roll tube 2. Liquid 12 clinging to or forced against inside wall 13 of roll tube may be heated and vaporized as soon as boiling temperature is attained due to the heat generated, e.g., by the operation of roll 1. The boiling temperature may be selectably set by the user by at least one of selecting a suitable liquid 12 and selecting a suitable pressure for interior space 11.

When liquid 12 vaporizes, the vaporization draws heat from roll tube 2 to fill interior space 11 with steam of the liquid 12. The steam may precipitate or condense at heat exchanger 14 due to the flow of coolant through heat exchanger 14. Further, heat exchanger 14 may jointly rotate with roll tube 2. That is, the precipitates or condensed liquid on heat exchanger 14 may be centrifuged toward and onto inside wall 13 due to the rotation of heat exchanger 14. As the precipitate liquid is forced onto inside wall 13, the liquid may be revaporized by the increasing temperature of roll tube 2 and, thus, restart the cooling process.

Because the coolant in heat exchanger 14 is circulated by rotary feeding device 18, and because the coolant flowing through heat exchanger 14 does not contact a surface of roll 1, the liquid temperature does not need to be constrained within narrow limits to ensure even cooling of roll tube 2, as is necessary in the prior art. That is, because the roll tube is cooled by the vaporization of the liquid film along inside wall 13 within interior space 1, the coolant in heat exchanger 14 may be allowed to heat considerably, e.g., by 10° C., 20° C. or more. Further, the temperature of the coolant in heat exchanger 14 may increase as long as the steam or vaporized liquid 12 continues to precipitate or condense on heat exchanger 14 in amounts sufficient to maintain the desired liquid film thickness along inside wall 13. Because the present invention allows the coolant within the heat exchanger to be heated to a certain extent, the volume flow of coolant through heat exchanger 14 can be kept low. Accordingly, only a small volume of coolant needs to be conducted through rotary feeding device 19, thus, facilitating the sealing of rotary feeding device 19.

Interior space 11 may be sealed gas-tight to produce a closed cycle of vaporization and condensation, i.e., from inside wall 13 of roll tube 2 to heat exchanger 14 to inside wall 13. Further, it is noted that liquids other than water, e.g., alcohols or other hydrocarbons, may be utilized as liquid 12.

Further, a drive 23 may be provided to exert a rotational force on roll 1. Drive 23 may be positioned to drive roll 1 at journal 3. Further, rotation of roll 1 may occur before nip 7 is closed. In this manner, the cooling of roll 1 may begin prior to operation of the system. It is noted that, as long as liquid 12 is not vaporized within roll tube 2, the temperature of the coolant flowing through heat exchanger 14 will not increase. Thus, no heat exchange occurs and no excessive cooling of roll tube 2 and the coating 22 occurs.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A roll comprising:

a roll tube having an outside surface and a sealed interior space;

an elastic coating provided on the outside surface;

a vaporizable liquid and a heat exchanger being positioned within the sealed interior space;

the heat exchanger comprising a coolant supplied to the heat exchanger from outside the roll tube; and a rotary feeding associated with at least one journal to supply the coolant.

2. A calender roll comprising:

a roll tube including a gas-tight section;

an elastic coating on a surface of the roll tube; and the gas-tight section comprising a vaporizable liquid and a heat exchanger.

3. The calender roll according to claim 2, the vaporizable liquid adapted to form a film over an interior wall of the gas-tight section.

4. The calender roll according to claim 2, the heat exchanger adapted to receive condensed vaporized liquid.

5. The calender roll according to claim 2, further comprising a journal; and the heat exchanger extending through the journal.

6. The calender roll according to claim 5, the journal comprising a static seal; and the heat exchanger extending through the static seal.

7. The calender roll according to claim 2, the gas-tight section forming a closed system, wherein vaporizing the vaporizable liquid cools the roll tube and the heat exchanger cools the vaporized liquid.

8. The calender roll according to claim 2, further comprising a drive motor for rotating the roll tube; and the heat exchanger coupled to rotate with the roll tube.

9. The calender roll according to claim 2, further comprising a pressure valve to adjustably vary the pressure within the gas-tight section.

10. The calender roll according to claim 2, the heat exchanger comprising a circulating coolant.

11. The calender roll according to claim 10, the coolant comprising one of water, alcohols and hydrocarbons.

12. A roll comprising:

a roll tube having an outside surface and a sealed interior space;

an elastic coating provided on the outside surface; and a vaporizable liquid and a heat exchanger being positioned within the sealed interior space.

13. The roll according to claim 12, a temperature of the heat exchanger being set to a temperature below a condensation temperature of a vaporized portion of the vaporizable liquid.

14. The roll according to claim 12, the sealed interior space being gas-tight.

15. The roll according to claim 12, further comprising:

journal bearings;

journals;

walls; and at least one of the journals and the walls closing axial extremities of the interior space.

16. The roll according to claim 12, the heat exchanger jointly rotating with the roll tube.

17. The roll according to claim 12, the heat exchanger comprising a coolant supplied to the heat exchanger from outside the roll tube.

18. The roll according to claim 12, the heat exchanger comprising a helical tube.

19. The roll according to claim 12, further comprising an evacuating device coupled to the interior space.

20. The roll according to claim 12, the elastic coating comprising plastic.

21. The roll according to claim 12, further comprising a roll rotary drive.

22. A method for cooling a roll having an elastic coating in use in a calender, the method comprising:

forming a vaporizable liquid film on an interior surface of the roll;

vaporizing the vaporizable liquid film to produce vaporized liquid;

condensing the vaporized liquid to produce a condensed liquid;

forcing the condensed liquid onto the interior surface of the roll;

forming a nip between the roll and a counter roll;

applying pressure in the nip; and calendering a web of material in the nip.

23. The method according to claim 22, the forming of the vaporizable liquid film comprising rotating the roll.

24. The method according to claim 22, the vaporizing of the vaporizable liquid film comprising heating the interior surface to a temperature at least equal to a boiling point temperature of the vaporizable liquid.

25. The method according to claim 24, the heating of the interior surface comprising:

in calendering the web of material, rotating the roll and the opposing roll, whereby an outer surface of the roll is frictionally heated.

26. The method according to claim 24, the heating of the interior surface comprising milling the elastic coating, whereby the elastic coating is frictionally heated.

27. The method according to claim 22, the condensing of the vaporized liquid comprising:

positioning a heat exchanger within the roll; and circulating a coolant having a temperature less than or equal to the condensation point of the vaporized liquid through the heat exchanger.

28. The method according to claim 22, further comprising:

providing a gas-tight seal to enclose the vaporizable liquid within the roll;

positioning a heat exchanger within the roll; and circulating a coolant through a heat exchanger to condense the vaporized liquid.

29. The method according to claim 28, further comprising:

rotating the heat exchanger to remove the condensed vaporized liquid.

30. The method according to claim 28, further comprising:

supplying the coolant from outside of the roll.

31. The method according to claim 22, the forcing of the condensed liquid comprising:

positioning a heat exchanger within the roll; and rotating the heat exchanger.

32. A calender comprising:

a first and a second calender roll arranged to form a calendering nip; and at least one of said first and said second calender roll comprising:

a roll tube having an elastic coating;

a sealed interior space; and a vaporizable liquid and a heat exchanger positioned within said sealed interior space.

* * * * *

UNITED STATES PATENT AND TRADEMARK OFFICE

CERTIFICATE OF CORRECTION

PATENT NO. : 6,405,790 B1
DATED : June 18, 2002
INVENTOR(S) : Rolf van Haag

It is certified that error appears in the above-identified patent and that said Letters Patent is hereby corrected as shown below:

Title page,
Item [*], delete “0” and insert -- 589 --.

Signed and Sealed this

Twenty-second Day of April, 2003

JAMES E. ROGAN
*Director of the United States Patent and Trademark Office*